United States Patent [19]

Uemura et al.

[11] Patent Number: 4,571,885

[45] Date of Patent: Feb. 25, 1986

[54] REVERSIBLE WINDOW WITH A MOVABLE ROTARY SHAFT

[75] Inventors: Noboru Uemura, Tokyo; Hiroaki Sahara, Chiba; Yasunori Hirayama, Saitama, all of Japan

[73] Assignee: Sumitomo Wall Systems, Ltd., Tokyo, Japan

[21] Appl. No.: 608,697

[22] PCT Filed: Apr. 28, 1983

[86] PCT No.: PCT/JP83/00131

§ 371 Date: Aug. 30, 1983

§ 102(e) Date: Aug. 30, 1983

[87] PCT Pub. No.: WO83/04278

PCT Pub. Date: Dec. 8, 1983

[30] Foreign Application Priority Data

Jun. 4, 1982 [JP] Japan ..... 57-94975

[51] Int. Cl.[4] ..... E05D 15/22

[52] U.S. Cl. ..... 49/177; 49/252

[58] Field of Search ..... 49/246, 251, 252, 253, 49/177

[56] References Cited

U.S. PATENT DOCUMENTS

| | | | |
|---|---|---|---|
| 1,103,377 | 7/1914 | Potter | 49/177 |
| 2,493,501 | 1/1950 | Reinmuller | 49/253 |
| 2,648,878 | 8/1953 | Albano | 49/252 |

*Primary Examiner*—Kenneth Downey

*Attorney, Agent, or Firm*—Flynn, Thiel, Boutell & Tanis

[57] ABSTRACT

A reversible window is disclosed, which can be reversed by rotation in such a manner that the outer side of the window comes to the inner side thereof, and in which a reverse rotation shaft (17), attached near the central portion of the upper surface of an upper window frame (12) of a window (1), is disposed so as to be slidable, and at the time of the 90-degree opening of the window (1), the window (1) can be moved up to the extreme end of its outer frame.

3 Claims, 17 Drawing Figures

REVERSIBLE WINDOW WITH A MOVABLE ROTARY SHAFT

FIELD OF THE INVENTION

The present invention relates to an improved reversible window having a movable rotary shaft which permits complete inside-out rotation of the window, and more particularly to a rotatable window which can be completely turned inside out about a rotary shaft which moves in accordance with the rotation of the window.

BACKGROUND OF THE INVENTION

Generally, the outsides of windows fixed to buildings are apt to become unclean and are difficult to clean. In order to eliminate the difficulty in cleaning the outside of a window, a window which permits easy cleaning of the outside thereof is conventionally known, which is constructed so as to be completely turned inside out, so that, when cleaning is necessary, its outside is directed to the inner side and its outside can be cleaned without difficulty from the inside of the room. In many of the windows of such a type, a rotary shaft is disposed in the center of the frame of the window, and the window can be rotated about the rotary shaft. However, in such windows, the area of the window that can be completely opened is half of a full size of the window at the most, and if the window is a small, such opened area will not serve as an emergency exit or a fire exit. In order to eliminate the shortcoming of the conventional reversible window, there can be proposed a window in which the rotary shaft is shifted from the center of the window frame to one side thereof. In this case, however, complete inside-out rotation of the window is not attained, so that complete cleaning of the outside of the window from the inner side is difficult.

Under such circumstances, there has been previously developed a reversible window having a movable rotary shaft as shown in FIG. 1. In the figure, reference numeral 1 represents a window; reference numeral 2, a rotary shaft; reference numeral 3, a guide projection; reference numeral 4, sash rollers; reference numerals 5 and 6, pinion gears; reference numerals 7 and 8, rack gears; reference numeral 9, a guide rail; and reference numeral 10, an arm member. The window 1 can be rotated about the rotary shaft 2. During the rotation of the window 1, the rotary shaft 2 is moved along the upper rack gear 7 and the lower rack gear 8 under the guidance of the upper pinion gear 5 and the lower pinion gear 6 which respectively engage the upper rack gear 7 and the lower rack gear 8. The movement of the rotary shaft 2 is also regulated by the arm member 10 as shown in FIG. 1. One end of the arm 10 is rotatably fixed to a reverse rotation shaft 17 fixed to the center of the upper window frame of the window 1 and the other end of the arm member 10 is rotatably fixed to one end portion of an outer frame 11 of the window 1 (refer to FIG. 2).

Referring to FIG. 2 and FIG. 3, the reversing of the window 1 will now be explained. Referring to FIG. 2, the window 1 is opened from its initial position, while the rotary shaft 2 engages the pinion gears 5 and 6 and the rack gears 7 and 8. When the window 1 comes to a position II via a position I, the window 1 is positioned at a right angle with respect to the initial position thereof as shown in FIG. 2. With further rotation, the window 1 is reversed and comes to a position III and finally to a position as shown in FIG. 3, where the window 1 is fitted in the initial position, but it is completely turned inside out with a 180-degree reverse rotation.

When the window 1 is at the position II, the window 1 cannot be moved up to the extreme end of the outer frame 11 due to the limitation of the length of the arm 10, and the window 1 is at a distance a from the extreme end of the outer frame as shown in FIG. 2.

Therefore, the maximum effective open width of the window at the position II with a 90-degree opening is W−a, where W is the entire width of the window 1. As a matter of course, if the window is used as an emergency exit and the maximum effective open width must be W, the outer frame must be designed so as to be greater than the width of the window by the size a.

In the above-described reversible window, the reverse rotation shaft 17 is secured to the center of the window frame of the window 1. In contrast to this, when the reverse rotation shaft 17 is shifted from the center of the window frame towards the fixing position of the arm member 10 on the side of the outer frame 11 of the window 1 as shown in FIG. 4(*a*), the window 1 can be moved up to the extreme end of the outer frame 11 when the window 1 is at the 90-degree opening position as shown in FIG. 4(*b*). However, further rotation of the window 1 for a 180-degree reverse rotation is impossible since the lower end of the window 1 is caught by the extreme end portion of the outer frame 11 and cannot be moved any further.

On the other hand, when the reverse rotation shaft 17 is shifted beyond the center of the window to the right, as shown in FIG. 5(*a*), using a longer arm member 10, the window 1 cannot be moved to the extreme end of the outer frame 11 when the window 1 is at the 90-degree opening position as shown in FIG. 5(*b*), and it cannot be fitted into the initial closing position even if 180-degree reversing is tried as shown in FIG. 5(*c*), since the right end portion of the window 1 comes beyond the right side of the outer frame 11 of the window 1.

The present invention is an improvement on the above-described shortcomings, by which improvement the complete 180-degree reversing of the window can be attained wherever the reverse rotation shaft 17 is positioned, and at the time of the 90-degree opening, the window can be moved up to the extreme end of its outer frame.

DISCLOSURE OF THE INVENTION

The present invention provides a reversible window with a movable reverse rotation shaft characterized in that, in a reversible window of a type in which one end portion of an inner frame of a window is rotatably fixed to a rotary shaft which can be moved along an outer window frame of the window, and an arm member connects a reverse rotary shaft disposed at an inner window frame and a portion of the outer window frame in such a manner that the window is permitted to make a 180-degree reverse rotation, the reverse rotary shaft is caused to move in accordance with the reversing of the window.

DETAILED DESCRIPTION OF THE BEST MODES OF THE PRESENT INVENTION

Referring to FIG. 6 through FIG. 9(*c*), an embodiment of a reversible window according to the present invention will now be explained.

Figure 1:
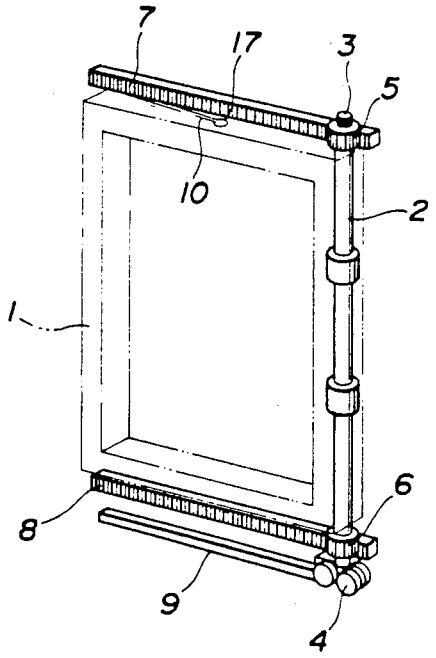
FIG. 1 PRIOR ART
FIG. 1 is a perspective view of a conventional reversible window with a movable rotary shaft in explanation of the mechanism thereof.
Figure 2:
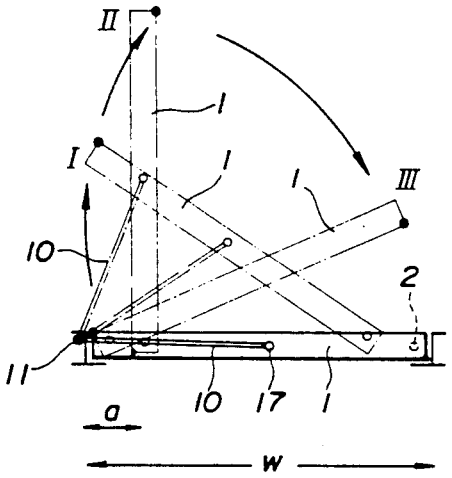
FIG. 2 PRIOR ART
FIG. 2 and FIG. 3 are schematic diagrams in further explanation of the reversible window shown in FIG. 1.
Figure 3:
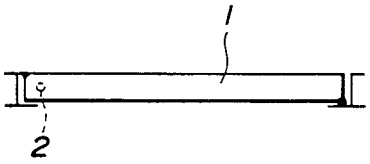
FIG. 3 PRIOR ART
Figure 4A:
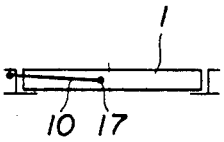
FIG. 4a PRIOR ART
FIGS. 4(*a*) and 4(*b*) and FIGS. 5(*a*) and 5(*b*) are schematic diagrams for explaining how the reversing mode of a window of the type shown in FIG. 1 changes depending upon the length of an arm member employed for reversing the window.
Figure 4B:
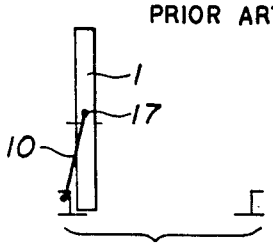
FIG. 4b PRIOR ART
Figure 5A:
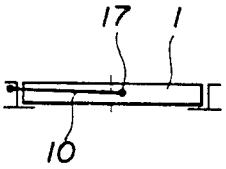
FIG. 5a PRIOR ART
Figure 5B:
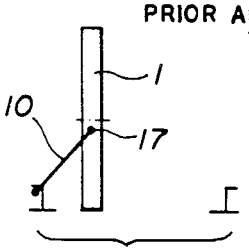
FIG. 5b PRIOR ART
Figure 5C:
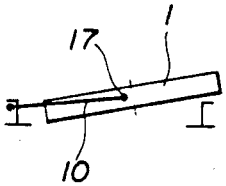
FIG. 5c PRIOR ART
Figure 6:
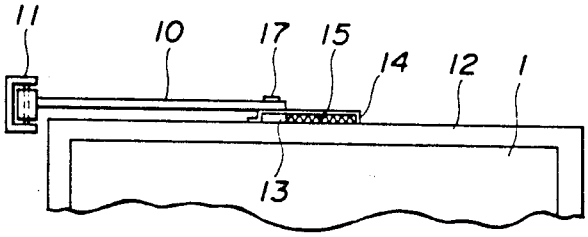
FIG. 6 is a partial front view of an embodiment of a reversible window according to the present invention.
Figure 7:
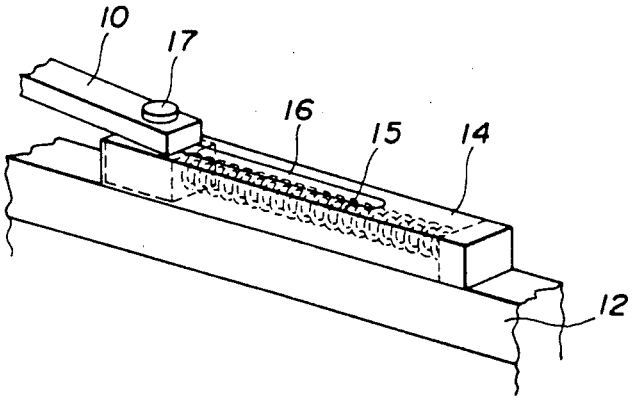
FIG. 7 is a perspective view of the main portion of the reversible window shown in FIG. 6.

FIG. 6 is a partial front view of the embodiment, which particularly shows its specific structure. FIG. 7 is a perspective view of the main portion of the reversible window shown in FIG. 6. In those figures, the left end portion of an arm member 10 is rotatably secured to an outer window frame 11, while the right end portion of the arm 10 member is secured to an operation member 13 through a reverse rotation shaft 17, which operation member 13 is attached to an upper inner window frame 12 near the central portion thereof, in sliding contact with the upper inner window frame 12. The reverse rotation shaft 17 is positioned on the left side of the center of the upper inner window frame 12 of the window 1 when the window 1 is closed. That position is just like the position of the reverse rotation shaft shown in FIG. 4(*a*). The operation member or slide 13 is incorporated in a casing or track 14, to which operation member 13, there is attached a spring member 15 which extends in the direction opposite to the arm member 10 as shown in Fig. 7. The operation member 13 can be moved to the right against the elastic resilience of the spring member 15 and can also be moved to the left by the elastic resilience, in sliding contact with the casing 14, guided by a groove 16 formed in the upper surface of the casing 14.

Figure 8A:
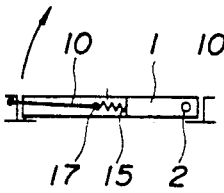
FIGS. 8(*a*), 8(*b*) and 8(*c*) and FIGS. 9(*a*) and 9(*b*) and 9(*c*) are schematic diagrams in explanation of the reversing mechanism of the reversible window according to the present invention shown in FIG. 6.
Figure 8B:
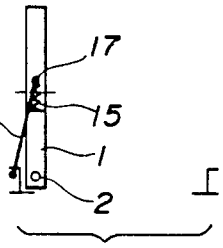
Figure 8C:
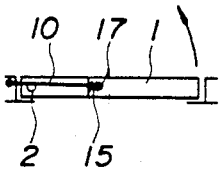

FIG. 8(*a*) schematically shows the initial position of the window 1 when the window 1 is closed as shown in FIG. 6. When the window 1 is rotated about the rotary shaft 2, while the rotary shaft 2 is moved to the left side, the window 1 is finally positioned as shown in FIG. 8(*b*). In the position shown in FIG. 8(*b*), the spring member 15 is stretched. As the window 1 is then reversed about the reverse rotation shaft 17, the reverse rotation shaft 17 is moved towards the center of the window 1, in sliding contact with the casing 14, against the elastic resilience of the spring member 15. Finally, the reverse rotation shaft 17 is pulled to the left by the arm member 10 and the window 1 is completely reversed and fitted into the same initial position as shown in FIG. 8(*a*). At this moment, the spring member 15 is in a compressed state. When the window 1 is reversed once again, it is quickly brought to the 90-degree open position by the elastic resilience of the compressed spring member 15, and the spring member 15 is stretched. Thereafter, the window 1 is smoothly returned to the initial closed position.

Figure 9A:
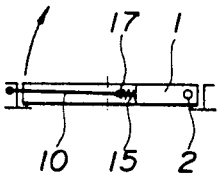
Figure 9B:
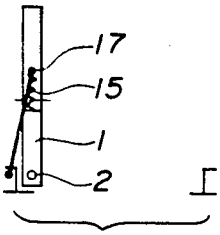
Figure 9C:
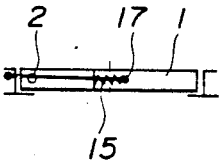

Referring to FIG. 9(*a*), there is shown the case where the arm member 10 is longer than in the case shown in FIGS. 8(*a*) through 8(*c*), and the reverse rotation shaft 17 is positioned on the right side of the center of the window 1. In this case, the spring member 15 is initially compressed. When the window 1 is opened with rotation about the rotary shaft 2, the reverse rotation shaft 17 is caused to slide, passing over the center of the window 1 and absorbing the excess length of the arm member 10, by the resilience of the spring member 15. As a result, the window 1 can be moved to the left end as shown in FIG. 9(*b*). With further rotation of the window 1, the window 1 can be completely reversed and fitted into the initial position as shown in FIG. 9(*c*).

When the reverse rotation shaft 17 is at the center of the window 1, the window 1 is reversed in almost the same manner as shown in FIGS. 9(*a*) through 9(*c*).

Figure 10:
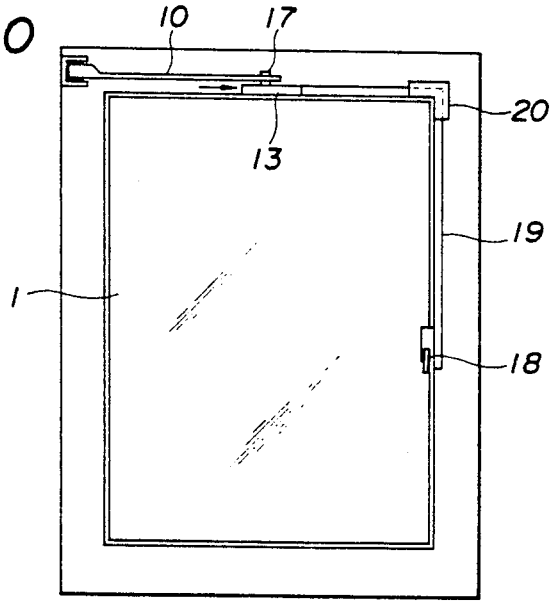
FIG. 10 is a front view of another embodiment of a reversible window according to the present invention.

Referring to FIG. 10, there is shown a front view of another embodiment of a reversible window according to the present invention.

In the above-described embodiment, the reverse rotation shaft 17 is moved by use of the spring member 15. In contrast to this, in this embodiment, there is disposed a slider 19 which can be moved vertically by rotating a fastening handle 18 of the window 1. The slider 19 is connected to the operation member 13 through a corner interlocking device 20. The vertical movement of the slider 19 is performed by a rack and a pinion incorporated in an attachment portion of the fastening handle 18. The corner portion of the corner interlocking device 20 is made of a plate spring. The arm member 10 is secured to the operation member 13 in the same manner as in the case shown in FIGS. 6 and 7.

The fastening handle 18 is unlocked by the first rotation, and by the subsequent rotation of the fastening handle 18, the slider 19 is vertically moved, whereby the reverse rotation shaft 17 is moved as shown in FIGS. 8(*a*) through 8(*c*) and FIGS. 9(*a*) through 9(*c*). Therefore, the engagement direction of the rack and the pinion built in the attachment portion of the fastening handle 18 in the case shown in FIGS. 8(*a*) through 8(*c*) and the engagement direction thereof in the case shown in FIGS. 9(*a*) through 9(*c*) are different.

The above are representative embodiments of the present invention. In addition to the above embodiments, the following embodiments can be provided, for instance, an embodiment in which the arm member securing position on the side of the window is fixed, while the arm securing position on the side of the outer window frame is movable; and an embodiment in which the length of the arm member itself is changeable, instead of changing the securing position of the arm member.

Furthermore, in the above embodiments, the arm member can be attached not only to the upper inner window frame, but also to the lower window frame.

INDUSTRIAL UTILIZATION OF THE PRESENT INVENTION

The present invention provides a reversible window with a movable rotary shaft, which window can be fully opened with respect to its entire window frame at the 90-degree opening of the window. Because of this structure, the reversible window allows easy cleaning not only of its inside, but also of its outside, and is capable of providing a maximum space for an emergency exit when it is opened. Therefore, this reversible window is particularly useful for multistorey buildings.

What is claimed is:

1. A window frame construction having an outer window frame having a window opening therein of a first defined width and an inner window frame of a second defined width to be received in said window opening and of a defined thickness, and reversible support means for supporting said inner window frame for swinging movement on said outer window frame and in said window opening between first and second positions which are 180° reversed from one another, said reversible support means comprising:

at least one arm and first hinge means for hingedly securing one end of said arm to said outer window frame and second hinge means for hingedly securing the other end of said arm to said inner window frame, said second hinge means defining a reverse rotation shaft for permitting said inner window frame to move between said first and second positions thereabout, control mean for controlling the relative positions between said inner and outer window frames so that a first plane of said inner window frame is oriented perpendicular to a second plane of said outer window frame when said inner window frame is located along one edge of said window opening in said outer window frame thereby making the available width of said window opening said first defined width less said defined thickness, said control means including slide means on at least one of said outer window frame and said inner window frame for movably supporting the associated one of said first and second hinge means for movement relative to said outer and inner window frames so that said inner window frame will be able to move from said position wherein said first plane thereof is perpendicular to said second plane to a 180° reversed position wherein said first and second planes are parallel.

2. A window frame construction according to claim 1, wherein said first hinge means includes a first hinge fixedly mounted on said outer window frame;

wherein said slide means includes an elongated track of a finite length mounted on said inner window frame and extending on opposite sides of a center of said width of said inner window frame and a slide member slidably mounted on said track for movement between first and second positions along said finite length;

wherein said second hinge means includes a second hinge mounted on said slide member for movement therewith along said length of said track; and wherein said slide means further includes a spring member located between one end of said track and said slide member for continually urging said slide member toward the other end of said track.

3. A window frame construction according to claim 1, wherein said first hinge means includes a first hinge fixedly mounted on said outer window frame;

wherein said slide means includes an elongated track on said inner window frame and extending on opposite sides of a center of said width of said inner window frame and a slide member slidably mounted on said track for movement between first and second positions along said finite length; and wherein said slide means further includes a pushing member and a fastening handle interlocked to said pushing member, said pushing member forceably pushing said second hinge means past said center and effecting a movement of said inner window frame to said 180° reversed position.

* * * * *